US008663346B2

(12) United States Patent
Brewer et al.

(10) Patent No.: US 8,663,346 B2
(45) Date of Patent: Mar. 4, 2014

(54) FUEL FORMULATIONS

(75) Inventors: Mark Lawrence Brewer, Chester (GB); Caroline Nicola Orlebar, Ince (GB); Richard John Price, Ince Chester (GB); Garo Garbis Vaporciyan, Houston, TX (US)

(73) Assignee: Shell Oil Company, Houston, TX (US)

( * ) Notice: Subject to any disclaimer, the term of this patent is extended or adjusted under 35 U.S.C. 154(b) by 121 days.

(21) Appl. No.: 12/953,226

(22) Filed: Nov. 23, 2010

(65) Prior Publication Data

US 2011/0120402 A1 May 26, 2011

(30) Foreign Application Priority Data

Nov. 24, 2009 (EP) ..... 09176880

(51) Int. Cl.
*C10L 1/18* (2006.01)

(52) U.S. Cl.
USPC ..... 44/387; 44/388; 44/389

(58) Field of Classification Search
None
See application file for complete search history.

(56) References Cited

U.S. PATENT DOCUMENTS

| | | | | |
|---|---|---|---|---|
| 2,331,386 | A | 10/1943 | Gaylor | 44/70 |
| 2,343,766 | A | 3/1944 | Gaylor | 44/71 |
| 4,891,049 | A * | 1/1990 | Dillon et al. | 44/387 |
| 4,902,279 | A * | 2/1990 | Schmidtz et al. | 604/134 |
| 4,904,279 | A * | 2/1990 | Kanne et al. | 44/387 |
| 5,004,480 | A | 4/1991 | Kanne | 44/387 |
| 5,425,790 | A | 6/1995 | Liotta, Jr. et al. | 44/443 |
| 6,387,138 | B1 * | 5/2002 | Murayama et al. | 44/387 |
| 6,652,608 | B1 | 11/2003 | Orr | 44/360 |
| 7,097,674 | B2 | 8/2006 | Delfort et al. | 44/349 |
| 2002/0134008 | A1 | 9/2002 | Waller et al. | 44/446 |
| 2004/0237384 | A1 | 12/2004 | Orr | 44/314 |
| 2005/0091912 | A1 * | 5/2005 | Schwab et al. | 44/300 |
| 2005/0210739 | A1 * | 9/2005 | Esen et al. | 44/605 |
| 2007/0204506 | A1 | 9/2007 | Brenes | 44/389 |
| 2008/0092436 | A1 | 4/2008 | Seames et al. | 44/308 |
| 2010/0005707 | A1 | 1/2010 | Jacob | 44/385 |

FOREIGN PATENT DOCUMENTS

| | | | |
|---|---|---|---|
| EP | 0277007 | 8/1988 | C10L 1/18 |
| EP | 0474342 | 3/1992 | C10L 1/18 |
| EP | 0728835 | 8/1996 | C10L 10/02 |
| EP | 0905217 | 3/1999 | C10L 1/02 |
| EP | 082688 | 6/2003 | C10L 1/02 |
| EP | 1992674 | 11/2008 | C10L 1/02 |
| JP | 61207496 | 9/1986 | C10L 1/18 |
| JP | 09040976 | 2/1997 | C10L 1/18 |
| JP | 2006037075 | 2/2006 | C10L 1/182 |
| WO | WO2008019325 | 2/2008 | C11C 3/10 |
| WO | WO2008104929 | 9/2008 | C10L 1/02 |
| WO | WO2008132917 | 11/2008 | C10L 1/02 |
| WO | WO2008135602 | 11/2008 | C10L 1/02 |
| WO | WO2008135801 | 11/2008 | |

OTHER PUBLICATIONS http://www.chemicalland21.com/industrialchem/IUH/FATTY%20ACIDS%20METHYL%20ESTERS%20(C12-18).htm.* http://chemicalland21.com/industrialchem/IUH/FATTY%20ACIDS%20METHYL%20ESTERS%20(C12-18).htm (evidentiary reference—no date available).*

G Knothe: "Evaluation of Ball and Disc Wear Scar Sata in the HFRR Lubricity Test", Lubrication Science, vol. 20, Oct. 2007, pp. 35-45.

Kenar J. A. et al, "Physical Properties of Oleochemical Carbonates", Mar. 2005, Journal of the American Oil Chemists Society, Springer, Berlin, DE LNKD-DOI: pp. 201-205.

Li D et al, "Effects of Dimethyl or Diethyl Carbonate as an Additive on Volatility and Flash Point of an Aviation Fuel", Elsevier, Amsterdam, NL LNKD—Journal of Hazardous Materials, vol. 161, No. 2-3, Jan. 2009, pp. 1193-1201.

Database WPI Week 200841, Thomson Scientific, London, GB; AN 2008-G54583 XP002571914, & W02008053837 A1 (Ube Ind Ltd) May 2008.

EPO, European Search Report dated Mar. 17, 2010, for Application 091768800.4 filed Nov. 24, 2009.

EPO, European Search Report dated Apr. 26, 2010, for Application 09176875.4 filed Nov. 24, 2009.

EPO, European Search Report dated Jun. 16, 2010, for Application 09176879.6 filed Nov. 24, 2009.

EPO, European Search Report dated Apr. 20, 2010, for Application 09176885.3 filed Nov. 24, 2009.

* cited by examiner

*Primary Examiner* — Pamela H Weiss

(57) ABSTRACT

A diesel fuel formulation is provided containing (i) a fatty acid alkyl ester (FAAE), in particular a fatty acid methyl ester (FAME), (ii) diethyl carbonate (DEC) and (iii) an additional diesel fuel component. Also provided is a diesel fuel supplement containing a FAAE and DEC. The inclusion of DEC, in a FAAE or in a diesel fuel formulation containing a FAAE, increase the stability of one or more glycerides present in the FAAE, and/or reduce the concentration of a stability-enhancing additive in the FAAE or fuel formulation, and/or reduce the amount of glyceride precipitates in the FAAE or fuel formulation. The glycerides are in particular saturated monoglycerides.

21 Claims, No Drawings

FUEL FORMULATIONS

This application claims the benefit of European Application No. 09176880.4 filed Nov. 24, 2009 which is incorporated herein by reference.

FIELD OF THE INVENTION

This invention relates to diesel fuel formulations, their preparation and their use.

BACKGROUND TO THE INVENTION

In the interests of the environment, and to comply with increasingly stringent regulatory demands, it is necessary to increase the amount of biofuels used in automotive fuels.

Biofuels are combustible fuels, typically derived from biological sources, which result in a reduction in "well-to-wheels" (i.e. from source to combustion) greenhouse gas emissions. In diesel fuels for use in compression ignition engines, the most common biofuels are fatty acid alkyl esters (FAMEs), in particular fatty acid methyl esters (FAMEs) such as rapeseed methyl ester and palm oil methyl ester; these are used in blends with conventional diesel fuel components.

Due to the incomplete esterification of oils (triglycerides) during their manufacture, FAMEs can contain trace amounts of glycerides, in particular monoglycerides. These glycerides tend, on cooling, to crystallise out before the FAMEs themselves. This can compromise the cold weather operability of fuel formulations containing FAMEs, since the crystallised glycerides can block fuel filters.

The most common monoglycerides present in FAAEs are the saturated C16:0 (palmitic) and C18:0 (stearic) monoglycerides, and the unsaturated C18:1 (oleic) and C18:2 (linoleic) monoglycerides. The amount of each of these which is present in a FAAE will depend on the nature of the FAAE and also on the process by which it was manufactured. It is the saturated monoglycerides which appear to have the most detrimental effect on cold weather performance of FAAE-containing fuels, since they are less soluble than for instance triglycerides and more prone to precipitate at low temperatures; they are also typically present at higher levels than triglycerides (the European specification EN 14214:2003 for FAMEs for use as diesel fuels allows 0.8% w/w of monoglycerides but only 0.2% w/w of triglycerides). Certain monoglycerides are also thought to be responsible for corrosion and injector fouling issues in fuels containing FAAEs.

The addition of a FAAE to a diesel fuel formulation also raises its cloud point and cold filter plugging point (CFPP), to an extent dependent on the FAAE concentration. This too can compromise the cold weather performance of the resultant blend. It can therefore be difficult to formulate diesel fuel/FAAE blends within the relevant regulatory specifications, particularly in colder climates where specifications require maximum cloud points and CFPPs to be lower than in more temperate regions.

As a result, FAAEs are typically included in diesel fuels, in particular winter grade fuels, at relatively low concentrations. Moreover FAAEs for use in diesel fuels need to be prepared to relatively stringent specifications as regards their glyceride contents, thus increasing the cost of their production. FAMEs for use in current diesel fuels are typically required to contain a maximum of 0.8% w/w monoglycerides (EN 14214); a market survey conducted in July 2006 by the European Biodiesel Board (www.ebb-eu.org) showed that most marketed diesel-grade FAMEs contained only ~0.44% w/w of monoglycerides.

It would be desirable to provide new biofuel-containing diesel fuel formulations which could overcome or at least mitigate these problems.

SUMMARY OF THE INVENTION

According to an embodiment of the present invention there is provided a diesel fuel formulation comprising (i) a fatty acid alkyl ester (FAAE), (ii) diethyl carbonate (DEC) and (iii) an additional diesel fuel component.

In another embodiment there is provided a diesel fuel supplement for use in a diesel fuel formulation, the supplement comprising (i) a fatty acid alkyl ester and (ii) diethyl carbonate.

Yet in another embodiment, a process for preparing the diesel fuel formulation and a method of operating an internal combustion engine and/or a vehicle which is driven by an internal combustion engine using the diesel fuel or the diesel fuel supplement is provided.

DETAILED DESCRIPTION OF THE INVENTION

DEC has been found to stabilise glycerides, in particular monoglycerides, which are present in a diesel fuel formulation containing a FAAE. It appears to increase their solubility in the formulation, thus reducing their tendency to crystallise out at low temperatures. This in turn can lower the cold filter plugging point (CFPP) of the formulation and improve its performance and its storage and handling characteristics at lower temperatures.

The present invention can thus make possible the use of FAMEs containing higher concentrations of glycerides, which are likely to be cheaper and more energy-efficient to produce, without unduly compromising the cold weather performance of the resultant diesel fuel formulations. It can allow the use of a wider range of FAAEs in diesel fuel formulations, and/or the use of higher concentrations of FAAEs than would otherwise have been feasible. The inclusion of the DEC can also help to bring a FAAE-containing diesel fuel within specification as regards its CFPP and/or its general cold weather performance; this can be of particular value where the fuel is for use in a colder climate.

Because of its ability to solubilise glycerides in diesel fuels, DEC may also be added to a FAAE-containing diesel fuel formulation in order to resolubilise already-formed glyceride precipitates, and hence at least partially to restore the previous cold weather performance of the formulation. In other words, DEC may be used not only to help prevent, but also in cases to reverse, glyceride crystallisation in a FAAE-containing diesel fuel formulation.

There can be additional advantages to the inclusion of DEC in a diesel fuel/FAAE mixture in accordance with the invention. DEC has a lower cloud point than FAAEs, and can thus lower the cloud point of a fuel formulation containing a FAAE. So long as the DEC is derived from a biological source, it can also increase the total bioenergy content of the formulation, yet with fewer of the drawbacks that can accompany higher FAAE concentrations.

Dialkyl carbonates such as DEC also have low toxicity and are biodegradable, and can be produced from renewable ingredients (carbon dioxide and bio-alcohols).

In an embodiment of the formulation, the FAAE may be any fatty acid alkyl ester (in particular a fatty acid methyl ester) suitable for inclusion in a diesel fuel formulation.

Fatty acid alkyl esters contain long chain carboxylic acid molecules (generally from 10 to 22 carbon atoms long), each having an alcohol-derived alkyl group attached to one end.

Organically derived oils such as vegetable oils (including recycled vegetable oils) and animal fats (including fish oils) can be subjected to a transesterification process with an alcohol (typically a $C_1$ to $C_5$ alcohol, more typically methanol) to form the corresponding fatty esters, typically mono-alkylated. This process, which is suitably either acid- or base-catalysed such as with the base KOH, converts the triglycerides contained in the oils into fatty acid esters and free glycerol, by separating the fatty acid components of the oils from their glycerol backbone. FAAEs can also be prepared from used cooking oils, or by standard esterification of fatty acids.

In an embodiment of the present invention, the FAAE may be any alkylated fatty acid or mixture of fatty acids. Its fatty acid component(s) may be derived from a biological source, for example a vegetable source. They may be saturated or unsaturated; if the latter, they may have one or more, for example up to 6, double bonds. They may be linear or branched, cyclic or polycyclic. In an embodiment, they are non-cyclic. Suitably they will have from 6 to 30 carbon atoms, or from 10 to 30 or from 10 to 22 or from 12 to 24 or from 16 to 18 carbon atoms, including the acid group(s) —$CO_2H$. A FAAE may comprise a mixture of different fatty acid esters of different chain lengths, depending on its source. For instance the commonly available rapeseed oil contains mixtures of palmitic acid (C16); stearic acid (C18); oleic, linoleic and linolenic acids (C18, with one, two and three unsaturated carbon-carbon bonds respectively); and sometimes also erucic acid (C22)—of these the oleic and linoleic acids form the major proportion. Soybean oil contains a mixture of palmitic, stearic, oleic, linoleic and linolenic acids. Palm oil usually contains a mixture of palmitic, stearic and linoleic acid components.

The FAAE may be derived from a natural fatty oil, for instance tallow oil or a vegetable oil such as rapeseed oil, soybean oil, coconut oil, sunflower oil, palm oil, peanut oil, linseed oil, camelina oil, safflower oil, babassu oil or rice bran oil. It may in particular be an ester of rapeseed, soy, palm or tallow oil.

The FAAE may be suitably a $C_1$ to $C_5$ alkyl ester, for example a methyl, ethyl, propyl (suitably isopropyl) or butyl ester. In an embodiment, it is a methyl or ethyl ester, in particular a methyl ester.

It may for example be rapeseed methyl ester (RME, also known as rape oil methyl ester or rape methyl ester), soy methyl ester (SME, also known as soybean methyl ester), palm oil methyl ester (POME), coconut methyl ester (CME) (in particular unrefined CME; the refined product is based on the crude but with some of the higher and lower alkyl chains (typically the C6, C8, C10, C16 and C18) components removed), tallow oil methyl ester (TME), and mixtures thereof. In general it may be either natural or synthetic, refined or unrefined ("crude").

In an embodiment, the FAAE is selected from RME, SME, POME and mixtures thereof. In an embodiment, it is selected from RME, POME and mixtures thereof. In another embodiment, the FAAE is RME. In yet another embodiment, the FAAE is POME.

In an embodiment, the FAAE suitably—although this is not essential—conforms to the European specification EN 14214 for fatty acid methyl esters for use as diesel fuels. It may have a flash point (IP 34) of greater than 101° C.; a measured cetane number (ASTM D613) of 55 or greater, or of 58 or 60 or 65 or even 70 or greater; a kinematic viscosity at 40° C. (IP 71 or EN ISO 3104) of from 1.9 to 6.0 centistokes, or from 3.5 to 5.0 centistokes; a density from 845 to 910 kg/m$^3$, or from 860 to 900 kg/m$^3$, at 15° C. (IP 365, EN ISO 12185 or EN ISO 3675); a water content (IP 386) of less than 500 ppm; a T95 (the temperature at which 95% of the fuel has evaporated, measured according to IP 123 or EN ISO 3405) of less than 360° C.; an acid number (IP 139) of less than 0.8 mgKOH/g, or of less than 0.5 mgKOH/g; and/or an iodine number (IP 84) of less than 125, or of less than 120 or less than 115, grams of iodine ($I_2$) per 100 g of fuel. It may also contain (e.g. by NMR) less than 0.2% w/w of free alcohol (e.g. methanol), less than 0.02% w/w of free glycerol and/or greater than 96.5% w/w esters.

The concentration of the FAAE, in a diesel fuel formulation according to the invention, may be 0.5% v/v or greater, or 1 or 2 or 3 or 4% v/v or greater, or in cases 4.5 or 5% v/v or greater. Its concentration may be up to 30% v/v, or up to 25 or 20 or 15 or 10% v/v.

The DEC may be obtained from any suitable source, of which many are available. It can for example be prepared by oxidative carbonylation of ethanol, or by transesterification of dimethyl carbonate with ethanol, or it may be generated as a co-product in the synthesis of monoethylene glycol from ethylene oxide and carbon dioxide via ethylene carbonate. The ethanol used in such processes may be bio-ethanol (i.e. ethanol derived from a biological source).

In an embodiment, it may be preferred for the DEC not to have been synthesised using phosgene ($COCl_2$), as this may introduce undesirable impurities such as chlorides or carbonochloridic acid derivatives. Such impurities may contribute to deposit, stability and corrosion problems in a fuel formulation.

The concentration of the DEC, in a diesel fuel formulation, may be 0.5% v/v or greater, or 1 or 2 or 3 or 4% v/v or greater, or in cases 4.5 or 5% v/v or greater. Its concentration may be up to 15% v/v, or up to 12 or 10 or 8 or 5% v/v.

The volume ratio of the FAAE to the DEC in the formulation may for instance be from 5:1 to 1:25, or from 2:1 to 1:25, or from 2:1 to 1:10. It may be from 2:1 to 1:5, or from 2:1 to 1:2, or from 2:1 to 1:1. It may be 1:1 or approximately 1:1.

The additional diesel fuel component (iii) may be any fuel component suitable for use in a diesel fuel formulation and therefore for combustion within a compression ignition (diesel) engine. It will typically be a liquid hydrocarbon middle distillate fuel, more typically a gas oil. It may be a kerosene fuel component. It may be petroleum derived. Alternatively it may be synthetic: for instance it may be the product of a Fischer-Tropsch condensation. It may be derived from a biological source.

An additional fuel component (iii) will typically boil in the range from 150 or 180 to 360° C. (ASTM D86 or EN ISO 3405). It will suitably have a measured cetane number (ASTM D613) of from 40 to 70 or from 40 to 65 or from 51 to 65 or 70.

In another embodiment, the formulation may contain a mixture of two or more additional diesel fuel components (iii).

The concentration of the component(s) (iii) in the formulation may suitably be 70% v/v or greater, or 75 or 80 or 85% v/v or greater, or 90 or 92 or 95% v/v or greater. It may be up to 98% v/v, or up to 95 or 92 or 90 or 85 or 80% v/v. In general, it will represent the major part of the fuel formulation. After inclusion of the FAAE (i), the DEC (ii) and any optional fuel additives, the component (iii) will typically represent the balance to 100%.

In an embodiment, the fuel formulation suitably has a CFPP (IP 309 or EN 116) of 5° C. or lower, or of 0° C. or lower, or of −5 or −10° C. or lower. It may have a CFPP of −15° C. or lower, or of −18° C. or lower, or of −20 or −25 or −30 or −35 or −44° C. or lower. It suitably has a cloud point (ASTM D5773) of 0° C. or lower, or of −5 or −10° C. or lower, or of −12 or −15 or −20 or −25 or −30° C. or lower. It suitably has a flash point (ASTM D92 or D93) of 40° C. or higher, or of 45 or 50 or 55° C. or higher.

The formulation should be suitable for use in a compression ignition (diesel) internal combustion engine. Such an engine may be either heavy or light duty. The formulation may in particular be suitable for use as an automotive diesel fuel.

In an embodiment, the formulation is suitable and/or adapted for use as a "winter grade" automotive diesel fuel, for use in colder climates such as in northern Europe (particularly Scandinavia) or North America. It may be a so-called "arctic grade" fuel, for use in particularly extreme climates such as in northern Scandinavia.

In further embodiments the formulation may be suitable and/or adapted for use as an industrial gas oil, or as a domestic heating oil.

The formulation will suitably comply with applicable current standard diesel fuel specification(s) such as for example EN 590 (for Europe) or ASTM D975 (for the USA). By way of example, the overall formulation may have a density from 820 to 845 kg/m$^3$ at 15° C. (ASTM D4052 or EN ISO 3675); a T95 boiling point (ASTM D86 or EN ISO 3405) of 360° C. or less; a measured cetane number (ASTM D613) of 51 or greater; a kinematic viscosity at 40° C. (ASTM D445 or EN ISO 3104) from 2 to 4.5 centistokes; a sulphur content (ASTM D2622 or EN ISO 20846) of 50 mg/kg or less; and/or a polycyclic aromatic hydrocarbons (PAH) content (IP 391 (mod)) of less than 11% w/w. Relevant specifications may however differ from country to country and from year to year, and may depend on the intended use of the formulation. Moreover a formulation according to the invention may contain fuel components with properties outside of these ranges, since the properties of an overall blend may differ, often significantly, from those of its individual constituents.

The relative concentrations of the components (i) to (iii) may be chosen to achieve desired properties for the formulation as a whole, for example a desired maximum CFPP and/or cloud point, and/or a desired minimum flash point. Thus the relative concentrations will also depend on the physicochemical properties of the individual components.

In an embodiment, the fuel formulation may contain standard fuel or refinery additives which are suitable for use in diesel fuels. Many such additives are known and commercially available.

According to another embodiment, there is provided a diesel fuel supplement for use in a diesel fuel formulation, the supplement containing (i) a FAAE and (ii) DEC. Thus, the FAAE may be premixed with DEC and then added to one or more diesel fuel components, such as a component (iii) of the type described above, in order to prepare a diesel fuel formulation.

The diesel fuel formulation may be prepared by blending together (i) a FAAE, (ii) DEC and (iii) one or more additional diesel fuel components, optionally with one or more fuel additives. The process may be used to produce at least 1,000 liters of the fuel formulation, or at least 5,000 or 10,000 or 25,000 liters, or at least 50,000 or 75,000 or 100,000 liters.

In an embodiment, the FAAE and DEC are premixed in an appropriate volume ratio, and the mixture then blended with the additional fuel component(s) (iii). The FAAE/DEC mixture may for instance be blended with the component(s) (iii) at a concentration of up to 50% v/v based on the product fuel formulation, or at a concentration of up to 45 or 40 or 35 or 30% v/v, or of up to 28 or 25 or 22 or 20% v/v, or of up to 15 or 10% v/v. It may be blended at a concentration of 1% v/v or greater based on the product formulation, or of 2 or 3 or 4 or 5% v/v or greater, or in cases of 6 or 7 or 8 or 9 or 10% v/v or greater. Adding the DEC to the FAAE can, by stabilising the glycerides present in the FAAE, help to improve its handling and storage properties, in particular at low temperatures.

In another embodiment, a method of operating an internal combustion engine, and/or a vehicle which is driven by an internal combustion engine, which method involves introducing into a combustion chamber of the engine the diesel fuel formulation described above or a diesel fuel supplement described above. The engine is suitably a compression ignition (diesel) engine. Such a diesel engine may be of the direct injection type, for example of the rotary pump, in-line pump, unit pump, electronic unit injector or common rail type, or of the indirect injection type. It may be a heavy or a light duty diesel engine.

Yet in another embodiment, DEC is introduced into a reservoir which contains a FAAE-containing diesel fuel formulation, prior to introduction of the resultant mixture into a combustion chamber of the engine. In other words, the diesel fuel formulation of the invention may be prepared in situ in a reservoir from which fuel is fed into an internal combustion engine.

DEC can be provided in a diesel fuel formulation containing a FAAE, in an effective amount to increase the stability of one or more glycerides in the formulation.

Increasing the stability of a glyceride may involve reducing its tendency, at any given temperature, to crystallise out of the formulation. It may therefore involve increasing the solubility of the glyceride, at any given temperature, in the formulation. It may result in a lowering of the CFPP of the formulation.

At least one of the glycerides may be a monoglyceride, in particular a saturated monoglyceride such as a C16:0 or a C18:0 monoglyceride. In an embodiment, at least one of the glycerides is an unsaturated C18 monoglyceride, such as a C18:1 monoglyceride.

The stability of a glyceride in a fuel formulation may for instance be assessed by measuring the concentration of dissolved glyceride in the formulation both before and after a predetermined period of storage and/or use. The storage and/or use may take place at a reduced temperature, for example −15 or −20° C. or lower. The greater the reduction in concentration of the dissolved glyceride during the test period, the more of it has crystallised out of the formulation and hence the lower its stability. An increase in stability will therefore result in a higher concentration of dissolved glyceride after any given time period, and/or in a given minimum concentration of dissolved glyceride being present for a longer period of time.

The diesel fuel formulation may contain one or more additional diesel fuel components in addition to the FAAE. It may in particular be a winter grade diesel fuel formulation. The DEC may for instance be used to increase the stability of the one or more glycerides at low temperatures, for instance −20° C. or below, or −25° C. or below, or −30° C. or below.

The invention may be used to achieve any degree of increase in the stability of the glyceride(s), and/or any degree of increase in the solubility of the glyceride(s) in the formulation. It may be used to achieve any degree of reduction in the CFPP of the formulation, and/or to achieve a CFPP at or below a desired target value. The CFPP of a fuel formulation can be assessed using a standard test method such as EN 116 or IP 309.

Again, increasing the stability of a glyceride may involve reducing its tendency, at any given temperature, to crystallise out of the FAAE or the FAAE/DEC mixture. It may involve increasing the solubility of the glyceride, at any given temperature, in the FAAE or the FAAE/DEC mixture. It may result in a lowering of the CFPP of the FAAE. It may thus be used to improve the low temperature storage and/or handling characteristics of the FAAE, and/or its low temperature performance for instance in a diesel fuel formulation.

The invention may be used to achieve any degree of increase in the stability of the glyceride(s) in the FAAE, and/or any degree of increase in their solubility, and/or to achieve a glyceride stability and/or solubility (in the FAAE) which is at or above a desired target value. It may be used to achieve any degree of reduction in the relevant CFPP, and/or to achieve a CFPP at or below a desired target value.

Since DEC can improve the stability of FAAE-containing diesel fuel formulations, it may make possible the use of lower levels of other stability-enhancing additives, with consequent savings in processing and cost.

A stability-enhancing additive may be any additive which is able to, or intended to, improve the stability of the formulation, in particular its low temperature stability. A stability-enhancing additive may be a cold flow additive, of the type which is typically included in diesel fuel formulations in order to improve their performance, and generally their stability, at lower temperatures. Many such additives are known; they include for example middle distillate flow improvers (MDFIs) and wax anti-settling additives (WASAs) such as ethylene vinyl acetate, poly-olefin esters, polyamides and olefin ester copolymers. Such additives may be included in a diesel fuel formulation so as to improve the low temperature operability of a system (typically a vehicle) running on the formulation. They may be included in order to reduce the amount of filter plugging caused by the formulation during its use in colder climates.

The term "reducing" embraces any degree of reduction, including reduction to zero. The reduction may for instance be 10% or more of the original stability-enhancing additive concentration, or 25 or 50 or 75 or 90% or more. The reduction may be as compared to the concentration of stability-enhancing additive which would otherwise have been incorporated into the fuel formulation in order to achieve the properties and performance required and/or desired of it in the context of its intended use. This may for instance be the concentration of stability-enhancing additive which was present in the formulation prior to the realisation that DEC could be used in the way provided by the present invention, and/or which was present in an otherwise analogous fuel formulation intended (e.g. marketed) for use in an analogous context, prior to adding DEC to it in accordance with the invention.

The reduction in stability-enhancing additive concentration may be as compared to the concentration of stability-enhancing additive which would be predicted to be necessary to achieve a desired target level of low temperature stability and/or performance, and/or a desired target CFPP, for the formulation in the absence of the DEC.

DEC may be added in an effective amount to reduce the concentration of a stability-enhancing additive in a FAAE, in particular a FAME.

DEC may be added in a diesel fuel formulation containing a FAAE in an amount effective to reduce the amount of glyceride precipitates in the formulation. Thus, as described above, DEC may be used to resolubilise—at least partially—glycerides which have already crystallised out of a FAAE-containing formulation. It may be used to restore, at least partially, the low temperature performance and/or properties of the formulation where they have been compromised by the crystallisation of glyceride impurities present in the formulation.

DEC may be added in a FAAE in an amount effective to reduce the amount of glyceride precipitates in the FAAE. Again, the DEC may be used to resolubilise—at least partially—glycerides which have already crystallised out of the FAAE. It may be used to restore, at least partially, the low temperature performance and/or properties of the FAAE where they have been compromised by the crystallisation of glyceride impurities present in it.

In the context of the present invention, "use" of DEC in a diesel fuel formulation or in a FAAE means incorporating the DEC into the formulation or FAAE, typically as a blend (ie a physical mixture) with one or more other diesel fuel components. The DEC will conveniently be incorporated before the formulation or FAAE is introduced into an engine or other system which is to be run on the formulation, or before the FAAE is incorporated into a diesel fuel formulation. Instead or in addition the use of DEC may involve running a fuel-consuming system, typically an internal combustion engine, on a diesel fuel formulation containing the DEC, typically by introducing the formulation into a combustion chamber of an engine.

In the context of the invention, "achieving" a desired target property also embraces—and in an embodiment involves—improving on the relevant target. Thus for instance DEC may be used to produce a fuel formulation which has a CFPP below a desired target value, or which exhibits a better cold flow performance or stability than a desired target.

Throughout the description and claims of this specification, the words "comprise" and "contain" and variations of the words, for example "comprising" and "comprises", mean "including but not limited to", and do not exclude other moieties, additives, components, integers or steps. Moreover the singular encompasses the plural unless the context otherwise requires: in particular, where the indefinite article is used, the specification is to be understood as contemplating plurality as well as singularity, unless the context requires otherwise.

Preferred features of each aspect of the invention may be as described in connection with any of the other aspects. Other features of the invention will become apparent from the following examples. Generally speaking the invention extends to any novel one, or any novel combination, of the features disclosed in this specification (including any accompanying claims and drawings). Thus features, integers, characteristics, compounds, chemical moieties or groups described in conjunction with a particular aspect, embodiment or example of the invention are to be understood to be applicable to any other aspect, embodiment or example described herein unless incompatible therewith. Moreover unless stated otherwise, any feature disclosed herein may be replaced by an alternative feature serving the same or a similar purpose.

The present invention will now be further described with reference to the following non-limiting examples.

Example 1

The monoglyceride (MG) contents of two FAMEs were measured using the standard test method EN 14105:2003. This European standard specifies a method to determine the free glycerol and residual mono-, di- and triglyceride contents in FAMEs intended for addition to mineral oils. The total glycerol content is then calculated from the results obtained.

The test method involves transformation of the glycerol and of the mono- and diglycerides into more volatile silylated derivatives in the presence of pyridine and of N-methyl-N-trimethylsilyltrifluoroacetamide (MSTFA). The silylated derivatives are analysed by gas chromatography on a short capillary column with thin film thickness, with an on-column injector or equivalent device, and flame ionisation detection.

The method used was correct to 0.01% w/w.

The FAMEs tested were rapeseed methyl ester (RME, ex. ADM) and palm oil methyl ester (ex. Patum Vegetable Oil Co, Ltd, Thailand). Their specifications are shown in Table 1 below.

TABLE 1

| Property | Test method | RME | POME |
|---|---|---|---|
| Ester content (% w/w) | EN 14103 | 99 | 99.45 |
| Density @ 15° C. (kg/m$^3$) | IP 365 | 883.3 | 875.7 |
| Viscosity @ 40° C. (mm$^2$/s) | IP 71 | 4.463 | 4.446 |
| Flash point (° C.) | IP 34 | 170 | 161.5 |
| Water content (mg/kg) | UK 3367 | 215 | 395 |
| Total contamination (particulates) (mg/kg) | IP 440 | 1.6 | 57.7 |
| Oxidation stability (Rancimat ™), 110° C. (hours) | EN 14112 | 8.9 | 12.5 |
| Acid value (mg KOH/g) | 139 | 0.16 | 0.33 |
| Iodine value (g/100 g) | IP 84 EN 14111 | 117 | 52 |
| Linolenic acid methyl ester (C18:3) (% w/w) | EN 14103 | 9.82 | 0.15 |
| Methanol content (% w/w) | CEN 14106 | <0.01 | <0.01 |

The MG contents of the FAMEs are shown in Table 2 below, for total MGs, saturated MGs (C16:0+C18:0), unsaturated MGs (C18:1+C18:2+C18:3), diglycerides (DG) and triglycerides (TG).

TABLE 2

| FAME | Total MG content (% w/w) | Saturated MG content (% w/w) | Unsaturated MG content (% w/w) | DG content (% w/w) | TG content (% w/w) |
|---|---|---|---|---|---|
| RME | 0.76 | 0.049 | 0.6612 | 0.13 | <0.01 |
| POME | 0.73 | 0.333 | 0.285 | 0.17 | 0.05 |

Diesel fuel formulations were then prepared by blending these FAMEs with a diesel base fuel DBF. This was a commercially available Swedish Class I diesel fuel formulated for use in colder climates and containing a relatively high concentration of aromatic hydrocarbons. It had a density at 15° C. (ASTM D4052) of 813.7 kg/m$^3$, an initial boiling point (ASTM D86) of 181° C., a T95 boiling point (ASTM D86) of 286° C., a final boiling point (ASTM D86) of 294° C., a measured cetane number (ASTM D613) of 56.3 and a kinematic viscosity at 40° C. (ASTM D445) of 1.96 mm$^2$/s.

Further formulations, in accordance with the present invention, were prepared by blending the FAMEs with both diethyl carbonate (DEC) and DBF. Blends of DBF and DEC alone were also prepared, as controls.

Saturated and unsaturated MG values for the prepared formulations were calculated based on the previously measured values for the neat FAMEs, reduced in proportion to their concentrations in the formulations.

The formulations and neat FAMEs were then stored at −20° C. for two weeks. At the end of the storage period, a sample was taken from the supernatant of each of the formulations/FAMEs and assessed for MG content, in the same way as for the neat FAMEs at the start of the test. The results are shown in Tables 3a and 3b below, for RME and POME respectively.

The neat DEC contained no monoglycerides, both before and after cold storage.

TABLE 3a (RME)

| RME concentration (% v/v) | DEC concentration (% v/v) | C16:0 + C18:0 pre-storage (% w/w) | C16:0 + C18:0 post-storage (% w/w) | C18 unsats pre-storage (% w/w) | C18 unsats post-storage (% w/w) |
|---|---|---|---|---|---|
| 5 | 0 | 0.005 | 0.001 | 0.034 | 0.012 |
| 5 | 5 | 0.004 | 0.001 | 0.033 | 0.022 |
| 2.5 | 2.5 | 0.002 | 0.001 | 0.016 | 0.011 |
| 10 | 0 | 0.008 | 0.003 | 0.068 | 0.018 |
| 10 | 10 | 0.007 | 0.005 | 0.060 | 0.060 |

TABLE 3b (POME)

| POME concentration (% v/v) | DEC concentration (% v/v) | C16:0 + C18:0 pre-storage (% w/w) | C16:0 + C18:0 post-storage (% w/w) | C18 unsats pre-storage (% w/w) | C18 unsats post-storage (% w/w) |
|---|---|---|---|---|---|
| 100 | 0 | 0.239 | 0.225 | 0.334 | 0.330 |
| 5 | 0 | 0.014 | 0.001 | 0.018 | 0.006 |
| 5 | 5 | 0.013 | 0.002 | 0.017 | 0.015 |
| 2.5 | 2.5 | 0.006 | 0.002 | 0.009 | 0.007 |
| 10 | 0 | 0.023 | 0.001 | 0.036 | 0.008 |
| 10 | 10 | 0.024 | 0.024 | 0.034 | 0.035 |

It can be assumed that differences between the pre- and post-storage MG concentrations are due to the precipitation of MG crystals. The data in Tables 3a and 3b show that in the FAME/base fuel blends, significant amounts of MGs crystallise out during cold storage. This effect can be reduced, however, by the inclusion of DEC at a concentration comparable to that of the FAME. For example, formulations containing 10% v/v FAME but no DEC showed significant reductions in supernatant MG levels after storage, whereas in the corresponding versions containing 10% v/v DEC, there was generally far less if any reduction in MG levels—in particular unsaturated MG levels—during storage. These formulations, containing both DEC and a FAME in accordance with the invention, would be likely to cause less fuel filter blocking at lower temperatures, to have generally better low temperature stabilities and to provide improved low temperature engine performance.

Tables 3a and 3b thus show that DEC can reduce the amount of MG precipitation from all of the FAME-containing formulations, leaving the post-storage MG levels much closer to those before storage. It therefore appears to stabilise the MGs present in the FAMEs.

It can be seen from this experiment that DEC may be used to stabilise FAAE-containing diesel fuel formulations, even at FAAE concentrations of 10% v/v or in cases greater. Thus the present invention can allow the formulation of a diesel fuel which contains a reasonable concentration of biofuel components, and yet which has better low temperature properties than would have been possible by incorporating a FAAE alone at the same or even a lower concentration. Using the DEC and the FAAE together in a diesel fuel formulation makes it easier to tailor the formulation to fit with relevant standards or to meet desired specification targets, in particular for winter grade fuels which face more stringent specifications than summer grade fuels.

Example 2

This example shows that DEC may be added to a cold FAAE-containing diesel fuel formulation to restore the MG content in the supernatant fuel to a near pre-cold storage level.

Two diesel fuel formulations were prepared, each containing 10% v/v RME in the diesel base fuel (DBF) of Example 1. Both formulations were subjected to two weeks' storage at −20° C. Their RME concentrations were measured both before and after storage, as were their supernatant levels of unsaturated MGs (C18:1+C18:2+C18:3).

At this point, one of the formulations (designated "A") was left untouched, whilst the other ("B") had ~10% v/v of cold DEC added to it (whilst still being maintained at a low temperature). Both formulations were then subjected to a further two weeks' storage at −20° C. Their final RME concentrations, and supernatant unsaturated MG levels, were recorded at the end of the second two weeks.

The results are shown in Table 4 below.

TABLE 4

| Storage | Formulation A | | | Formulation B | | |
|---|---|---|---|---|---|---|
| time point | Pre | 2 wks | 4 wks | Pre | 2 wks | 4 wks |
| % v/v RME | 9.2 | 9.0 | 9.5 | 9.1 | 9.0 | 8.8 |
| % w/w C18:1/2/3 | 0.068 | 0.017 | 0.015 | 0.068 | 0.017 | 0.049 |

As expected, the levels of supernatant MGs are reduced during the initial two week storage period, indicating that crystallisation has taken place. In formulation A, this MG crystallisation continues, resulting in a further reduction in supernatant MG levels by the end of week 4.

In contrast, in formulation B the addition of the DEC after the first two weeks appears to redissolve the initially formed MG crystals. The supernatant MG level is restored to a level close to its pre-storage value, even after a further two weeks' cold storage.

These results show that DEC may be used not only to reduce the likelihood of MG crystallisation occurring (i.e. as a preventative) but also to reverse crystallisation which has already occurred (i.e. as a restorative). For example, DEC may be added to a FAAE-containing diesel fuel formulation which has been found to suffer from low temperature stability problems, and/or which has already suffered an impairment of its low temperature performance or properties, in order to restore the formulation at least partially to a desired specification. It may be added to a FAAE-containing fuel which has been found to cause unexpected filter blockages, for example in cooler weather or following a filter change. For these purposes, the DEC may be added to the fuel formulation at any stage prior to its combustion, for example at the refinery, at the pump, in the fuel tank of a vehicle or in any other reservoir which supplies the formulation to an internal combustion engine.

What is claimed is:

1. A diesel fuel formulation comprising (i) a fatty acid alkyl ester (FAAE), (ii) diethyl carbonate (DEC), (iii) a middle distillate fuel, and (iv) a monoglyceride, wherein the volume ratio of the FAAE to the DEC in the formulation is from 5:1 to 1:10.

2. The formulation of claim 1 wherein the FAAE is a fatty acid methyl ester (FAME).

3. The formulation of claim 2 wherein the FAAE is rapeseed methyl ester (RME).

4. The formulation of claim 2 wherein the FAAE is palm oil methyl ester (POME).

5. The formulation of claim 1 wherein the concentration of the FAAE is from 0.5 to 30% v/v.

6. The formulation of claim 5 wherein the concentration of the DEC is from 0.5 to 15% v/v.

7. A diesel fuel supplement for use in a diesel fuel formulation, the supplement comprising (i) a FAAE, (ii) DEC, and (iii) a monoglyceride, wherein the volume ratio of the FAAE to the DEC in the formulation is from 5:1 to 1:10.

8. A process for the preparation of a diesel fuel formulation comprising blending together at least (i) a FAAE, (ii) DEC, (iii) a middle distillate fuel, and a monoglyceride, wherein the volume ratio of the FAAE to the DEC in the formulation is from 5:1 to 1:10.

9. A method of operating an internal combustion engine, and/or a vehicle which is driven by an internal combustion engine comprising introducing into a combustion chamber of the engine a diesel fuel formulation of claim 1.

10. A method of operating an internal combustion engine, and/or a vehicle which is driven by an internal combustion engine comprising introducing into a combustion chamber of the engine a diesel fuel formulation of claim 2.

11. A method of operating an internal combustion engine, and/or vehicle which is driven by an internal combustion engine comprising introducing into a combustion chamber of the engine a diesel fuel supplement of claim 7.

12. The method of claim 9 wherein DEC in the diesel fuel is present in an amount effective to increase the stability of glycerides present in the FAAE.

13. The formulation of claim 1 wherein the concentration of the middle distillate fuel is at least 70% v/v.

14. The process of claim 8 wherein the concentration of the middle distillate fuel is at least 70% v/v.

15. The process of claim 8 wherein the blending step comprises mixing the FAAE and DEC together to form a mixture before blending the mixture with the middle distillate fuel.

16. The process of claim 15 wherein the concentration of the mixture of FAAE and DEC is at least 1% v/v based on the diesel fuel formulation.

17. The diesel supplement of claim 7 wherein the FAAE is a fatty acid methyl ester (FAME).

18. The diesel supplement of claim 7 wherein the FAAE is rapeseed methyl ester (RME).

19. The formulation of claim 1 wherein the monoglyceride comprises a saturated monoglyceride.

20. The diesel supplement of claim 7 wherein the monoglyceride comprises a saturated monoglyceride.

21. The process of claim 8 the monoglyceride comprises a saturated monoglyceride.

* * * * *